United States Patent [19]

Reid et al.

[11] 4,365,806

[45] Dec. 28, 1982

[54] RACKETS

[76] Inventors: Cedric N. Reid, 19 Westminster Croft, Brackley, Northamptonshire, England; George W. Anderson, c/o Elite Sports International Ltd., Flying Horse Rd., Downpatrick, County Down, Northern Ireland

[21] Appl. No.: 266,127

[22] Filed: May 21, 1981

[30] Foreign Application Priority Data

May 20, 1980 [GB] United Kingdom ..... 8016673

[51] Int. Cl.[3] ..... A63B 51/00; A63B 49/02

[52] U.S. Cl. ..... 273/73 C; 273/73 D

[58] Field of Search ..... 273/73 R, 73 C, 73 D, 273/73 F, 73 G, 73 H

[56] References Cited

U.S. PATENT DOCUMENTS

| | | | |
|---|---|---|---|
| 3,664,669 | 5/1972 | Latham et al. | 273/73 D |
| 3,986,716 | 10/1976 | Taussig et al. | 273/73 D X |
| 4,005,862 | 2/1977 | Portz et al. | 273/73 D |

FOREIGN PATENT DOCUMENTS

| | | | |
|---|---|---|---|
| 2307942 | 9/1973 | Fed. Rep. of Germany | 273/73 D |
| 2263795 | 10/1975 | France | 273/73 D |
| 14247 | of 1884 | United Kingdom | 273/73 H |
| 269955 | 5/1927 | United Kingdom | 273/73 D |

*Primary Examiner*—Richard C. Pinkham
*Assistant Examiner*—Matthew Schneider
*Attorney, Agent, or Firm*—Young & Thompson

[57] ABSTRACT

A racket, especially for tennis and squash, has a strung head portion defined by a rigid frame of novel cross-sectional configuration. The frame has an imperforate wall extending around the greater part of the racket head, and integral with the wall a rigid section which is perforated at intervals to receive the stringing and which is formed as an elongate hollow protuberance projecting at least partially inwardly of the wall towards the center of the racket head. The main section of the frame is preferably a closed section, which may be internally divided into a plurality of discrete cells. The protuberant hollow section may be substantially circular in cross-section or generally rectangular in cross-section for example.

7 Claims, 5 Drawing Figures

RACKETS

FIELD OF THE INVENTION

This invention relates to rackets used in the playing of games where strung rackets are used. Much development work has been carried out in recent years with tennis rackets with a view to improving their playing characteristics. Squash rackets on the other hand have been less subject to change, particularly in relation to the head of the racket, primarily because of the strict rules which govern the type of racket which may be used. For example, although it has been known for some years now to make tennis rackets with metal frames, it is only very recently that squash rackets with metal frames have been produced and tested. Contrary to expectations, it has been found that a metal frame squash racket is no more dangerous to the playing surfaces of the court or to an opponent than the conventional racket with a wooden head.

DESCRIPTION OF THE PRIOR ART

However, regardless of what materials have been used in the past for tennis rackets or squash rackets or other rackets, one conventional way to string the racket head has been to thread the strings through holes made right through the frame, so that the strings pass back and forth through the thickness of the frame from the inside to the outside and vice versa. However, these holes through the frame are inherent points of weakness, whether the frame is made of wood or metal, and can give rise to cracking or fracture of the frame when the racket is put under stress.

Other rackets are known, especially for use as tennis rackets, which include a flange extending around the inside of the racket head frame with the flange being perforated at intervals to take the strings. With such constructions, unless the flange is relatively massive, points of weakness can occur which again give rise or cracking or fracture of the frame.

Yet other rackets, particularly tennis rackets, have been proposed which have the strings extending around rollers mounted at intervals around the internal periphery of the racket head. Such an arrangement is primarily designed to enable the strings to be tightened to an appropriate tension relatively simply, but the general construction is usually complex, unattractive aesthetically, and generally expensive to manufacture.

SUMMARY OF THE INVENTION

It is an object of the present invention to provide an improved racket, especially a metal frame racket, which avoids the need to provide string holes through the thickness of the frame.

It is a further object of the invention to provide a racket which can be made from an extrusion, and which has exceptional strength, particularly torsional strength.

It is a further object of the invention to provide a racket having a frame which is simple to manufacture and which is relatively cheap to produce.

Although reference is made hereinafter to the use of a metal or metal alloy as an extrusion material, it should be understood that any other suitable material which is capable of extrusion could alternatively be used, for example a plastics material having the necessary properties. Furthermore, although reference is made herein to the use of an extrusion, because it is simple to produce and convenient to use, any other method of producing a racket frame embodying the novel structure of the present invention could alternatively be used.

In accordance with the present invention there is provided a racket for a game, comprising a strung head portion defined by a rigid frame, and a handle portion connected to or an extrusion of the frame, wherein the frame comprises an imperforate wall extending around the greater part of the racket head, and, integral with the wall, a rigid fixed section substantially co-extensive with said wall and perforated at intervals to recieve the stringing, the rigid fixed section being formed as an elongate hollow protuberance projecting at least partially inwardly of said wall towards the centre of the racket head.

The elongate protuberance is preferably part-circular in cross-section, although other shapes may alternatively be used.

Preferably, the imperforate wall is the inner wall of a closed section of tubing. This closed section may be internally divided into a plurality of discrete cells. Such an arrangement has been found to give particularly good torsional strength.

The elongate protuberance may be formed as an eye or loop with at least part of its volume extending towards the centre of the racket beyond the contour defined by the inner face of the main section of the frame.

BRIEF DESCRIPTION OF THE DRAWINGS

In order that the invention may be fully understood, a number of embodiments in accordance with the invention will now be described by way of example and with reference to the accompanying drawings, in which.

DESCRIPTION OF THE PREFERRED EMBODIMENT

Figure 1:
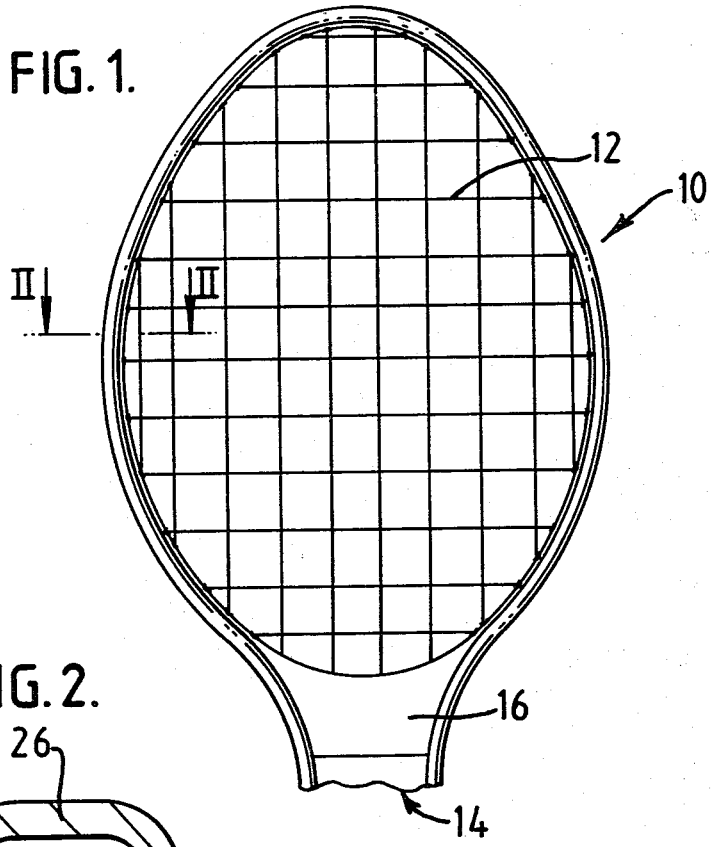
FIG. 1 is a schematic view of the head portion of a racket embodying the frame structure of the present invention.

FIG. 1 shows a racket 10 comprising a rigid frame which in the head portion carries stringing 12 and which includes a handle portion partially shown at 14. A throat piece 16 is provided at the junction between the handle portion 14 and the head portion. The rigid frame is preferably of metal or a metal alloy, although other rigid materials may be used. The frame is preferably shaped from a length of extruded material.

Figure 2:
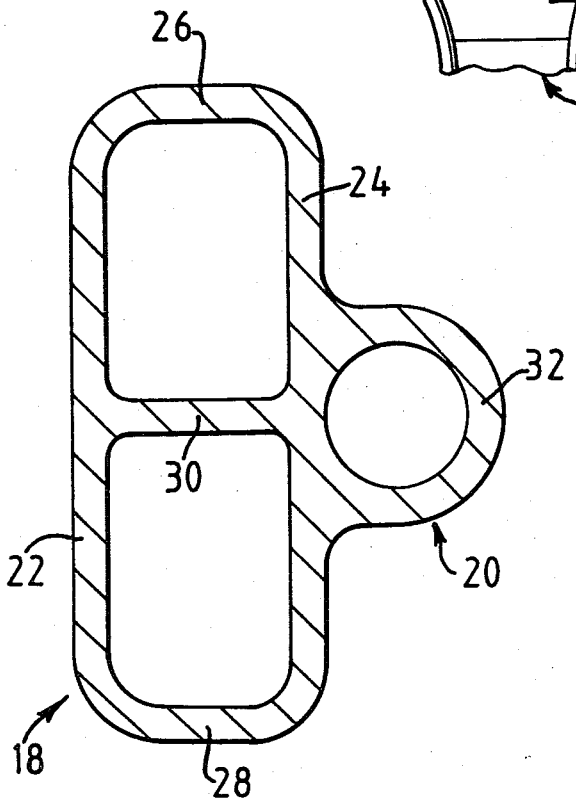
FIG. 2 is a cross-sectional view through a first embodiment of racket frame taken along the line II—II in FIG. 1.

The particular extrusion shown in FIG. 2 as being suitable for at least the head portion of the racket frame comprises a main section indicated generally at 18 and a supplementary section indicated generally at 20. The main section 18 comprises a continuous outside wall 22 which constitutes the outside face of the racket head, a continuous inside wall 24, and upper and lower wall portions 26 and 28 which in combination constitute a closed cell. In the particular embodiment which is illustrated, there is a dividing wall 30 across the centre of the main section to divide it into two closed cells. This closed cell structure provides great strength, especially when the racket is subjected to torsional stress. It has only recently been discovered that rackets used for games such as tennis and squash are subjected to considerable torsional stress in use, and conventional rackets do not always react favourably to such stress.

Figure 3:
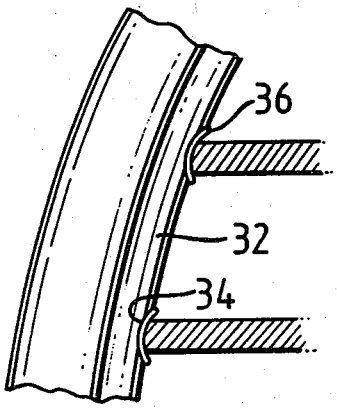
FIG. 3 is a detail view of a portion of the frame to illustrate the perforations which receive the strings.

In FIG. 2 the supplementary section 20 of the extrusion integral with the main section 18, consists of an elongate ring or eye 32 which extends out from the inner wall 24 of the main section, i.e. projects inwardly towards the centre of the racket head. This eye, extending all round the inside of the racket head, provides the anchorage for the strings 12. Because the strings are anchored to this internal eye there is no weakening of the inherent strength of the basic closed cell structure of the frame. As can be seen from FIG. 3, holes 34 are made through the eye section 32 at intervals along its length. These holes 34 may be formed by a routing operation for example, or alternatively by a milling or shearing process. Preferably, the racket frame is held in a rigid support and the holes are made either singly, or in groups, or altogether, depending upon the process used. If desired, grommets 36 may be fitted into the holes 34 to prevent any danger of the strings being broken by rubbing against the edges of the holes. These grommets 36 may be made as sleeves of a suitable plastics material. The strings 12 are passed along through the hollow center of the eye section 32 and in and out of the holes 34. Alternatively, or additionally, the holes may be specially shaped to reduce frictional rubbing between the strings and the edges of the holes.

Various alternative extrusion cross-sections could be used. For example, as shown in FIG. 4, the supplementary or eye section 20 need not necessarily be positioned wholly on the side of the main section 18 towards the centre of the racket head, but can be aligned with the centre line of the main section wall 24 so that it is positioned half in and half out of the main section cell.

Again, although it is preferred to use a supplementary section 20 which is substantially circular in cross-section, because of the inherent strength of a circle, other cross-sectional shapes could be used. For example, as shown in FIG. 5, a substantially rectangular supplementary section with rounded corners could be used.

Figure 4:
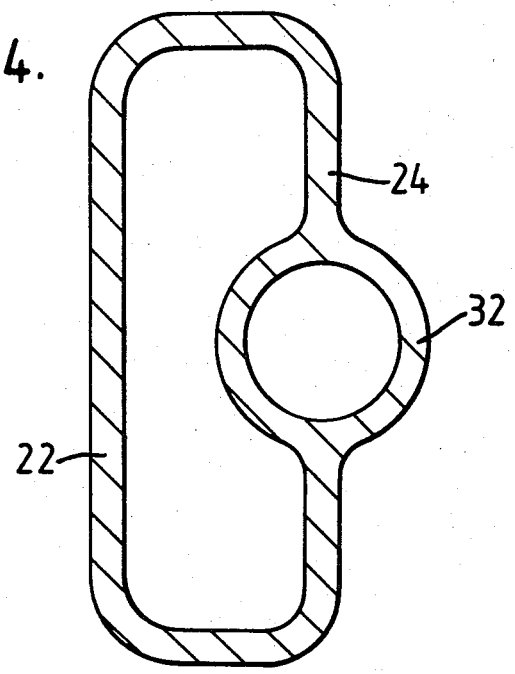
FIG. 4 is a cross-sectional view through a second embodiment of racket frame; and, FIG. 5 is a cross-sectional view through a third embodiment of racket frame.
Figure 5:
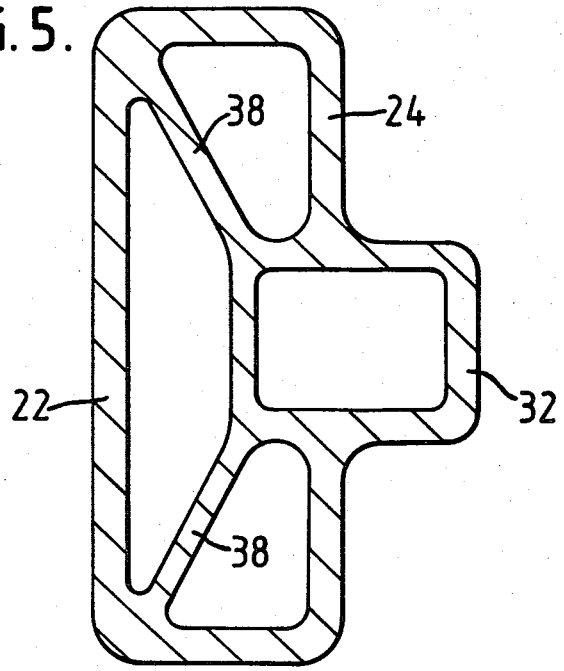

So far as the main section 18 is concerned, one can omit the internal dividing wall 30 altogether, as shown in FIG. 4, or alternatively include additional internal reinforcing walls, as indicated at 38 in FIG. 5. Whether internal dividing walls are used, and if so in what number and with what configuration, depends upon the strength required for the racket and the materials used.

A further advantage of providing a frame which incorporates a hollow closed section 18 is that this can be used to adjust the balance and feel of the racket. One can provide a number of removable inserts (not shown) which are pushed into and around the racket head through the hollow main section 18 in order to increase or reduce the weight of the head of the racket in accordance with the wishes of the player.

Although the main section 18 is here shown as a fully closed cell, primarily for strength reasons, for certain rackets it may be possible to omit the outside wall and the dividing wall 30, thereby creating a substantially C-shaped main section, which would then be closed around the circumference of the racket head by an insertable buffer strip or the like.

As can be seen from FIG. 1, the ends of the extrusion from which the racket frame is made, i.e. those portions between the throat 16 of the racket and the handle, may have the supplementary section 20 removed.

We claim:

1. A racket for a game, comprising a strung head portion defined by a rigid frame, and a handle portion connected to or an extension of the frame, wherein the frame comprises an imperforate wall extending around the greater part of the racket head, and, integral with the wall, a rigid fixed section substantially coextensive with said wall, said fixed section having perforations at intervals to receive the stringing, said rigid fixed section being formed as an elongate hollow protuberance projecting at least partially inwardly of said wall towards the center of the racket head and being closed except for said perforations, the geometric center of the perforations lying in the plane of stringing.

2. A racket according to claim 1, in which the elongate protuberance is part-circular in cross-section.

3. A racket according to claim 1, in which the elongate protuberance is substantially rectangular in cross-section with rounded corners.

4. A racket according to claim 1, in which the elongate protuberance is aligned substantially on the centre-line of the imperforate wall.

5. A racket according to claim 1, in which the imperforate wall is the inner wall of a closed section.

6. A racket according to claim 5, in which the closed section is internally divided into a plurality of discrete cells.

7. A racket according to claim 1, in which grommets are positioned in each of the perforations for the stringing.

* * * * *